US007743908B2

(12) United States Patent
Haul

(10) Patent No.: US 7,743,908 B2
(45) Date of Patent: Jun. 29, 2010

(54) RECEIVE DEVICE AND CONVEYOR METHOD

(75) Inventor: Michael Haul, Kroeppelshagen (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 12/140,588

(22) Filed: Jun. 17, 2008

(65) Prior Publication Data

US 2008/0308387 A1 Dec. 18, 2008

(30) Foreign Application Priority Data

Jun. 18, 2007 (DE) ..... 10 2007 028 478

(51) Int. Cl.
*B65G 47/31* (2006.01)

(52) U.S. Cl. ..... 198/461.1; 198/459.1

(58) Field of Classification Search ..... 198/459.1, 198/461.1, 461.2, 606, 626.1, 689.1
See application file for complete search history.

(56) References Cited

U.S. PATENT DOCUMENTS

| | | | | |
|---|---|---|---|---|
| 1,920,563 | A * | 8/1933 | Jahne | 198/461.1 |
| 3,404,921 | A * | 10/1968 | Vergales et al. | 406/70 |
| 4,311,229 | A | 1/1982 | Bennett | |
| 4,551,040 | A | 11/1985 | Kasparek et al. | |
| 5,651,643 | A * | 7/1997 | Haul et al. | 406/3 |
| 5,823,528 | A * | 10/1998 | Draghetti et al. | 198/461.1 |

FOREIGN PATENT DOCUMENTS

| | | |
|---|---|---|
| DE | 66 033 39 | 9/1969 |
| DE | 26 41 934 | 3/1977 |
| DE | 29 26 792 | 1/1981 |
| DE | 34 17 483 | 11/1984 |
| DE | 44 31 273 | 3/1996 |
| DE | 101 55 292 | 5/2003 |
| EP | 0 699 396 B1 | 2/2002 |
| EP | 1 397 968 | 3/2004 |
| GB | 814385 | 6/1959 |

* cited by examiner

*Primary Examiner*—James R Bidwell
(74) *Attorney, Agent, or Firm*—Greenblum & Bernstein, P.L.C.

(57) ABSTRACT

A receive device of a conveyor unit, an apparatus including the receive device and a method for transporting rod-like articles for tobacco-processing. The receive device includes a deceleration device to decelerate the rod-like articles and an acceleration device to accelerate the rod-like articles. The acceleration device is arranged downstream from the deceleration device. A conveyor speed limit device is located between the deceleration device and the acceleration device. The instant abstract is neither intended to define the invention disclosed in this specification nor intended to limit the scope of the invention in any way.

14 Claims, 3 Drawing Sheets

RECEIVE DEVICE AND CONVEYOR METHOD

CROSS-REFERENCE TO RELATED APPLICATIONS

The present application claims priority under 35 U.S.C. § 119 of German Patent Application No. 10 2007 028 478.2 filed Jun. 18, 2007, the disclosure of which is expressly incorporated by reference herein in its entirety.

BACKGROUND OF THE INVENTION

1. Field of the Invention

The invention relates to a receive device of a conveyor apparatus for the transport of rod-like articles, in particular filter rods, of the tobacco-processing industry. The receive device has a device decelerating the rod-like articles, e.g., a first brake device, and a device accelerating the rod-like articles, e.g., an acceleration device. The acceleration device is arranged downstream from the first brake device.

Furthermore, the invention relates to a method for conveying rod-like articles, in particular filter rods, of the tobacco-processing industry. The articles are longitudinal-axially conveyed into a first brake device and are then decelerated to a first predetermined speed in the first brake device.

2. Discussion of Background Information

A corresponding receive device and a corresponding conveyor method are known for example from EP 1 397 968 B1. A corresponding filter rod receiver or a corresponding receive device for rod-like articles of the tobacco-processing industry normally receives longitudinal-axially articles, which are first decelerated in order to then be accelerated longitudinal-axially. The articles are subsequently conveyed transversely to their axes to a filter hopper. Different module variants are hereby known. For example, there are individual receivers, double receivers and triple receivers. It is also possible, depending on the requirement for articles, to control the speed of the filter rod receiver or a receive device.

SUMMARY OF THE INVENTION

The present invention increases the operational reliability of a receive device of a conveyor apparatus for the transport of rod-like articles of the tobacco-processing industry and in a method for conveying rod-like articles of the tobacco-processing industry.

According to the invention, a receive device of a conveyor apparatus for the transport of rod-like articles, in particular filter rods, of the tobacco-processing industry includes a device decelerating the rod-like articles, such as a first brake device, and a device accelerating the rod-like articles, such as an acceleration device. The acceleration device is arranged downstream from the first brake device, and a conveyor speed limit device is provided between the first brake device and the acceleration device.

In the case of the longitudinal transport of rod-like articles of the tobacco-processing industry, the receive device according to the invention has the function of equalizing the speed of filter rods entering the receive device in undefined states from a pipeline or conveyor apparatus and producing a hole, void or gap required for the diagonal or crosswise transport. It can be that the articles conveyed with compressed air in the conveyor apparatus lead to irregularities, which lead to a pressure surge in the receive device, which worsen the equalization of the speed of the articles in the receive device, for example through the acceleration of a corresponding article. Thus, it can be that the wanted gap is too small, so that problems can result in the operation of a corresponding conveyor unit, for example a jam or the damage of articles.

Through the use of the conveyor speed limit device according to the invention, the articles are prevented from being able to be accelerated too strongly in the receive device or the articles are prevented from being accelerated above a specifiable speed.

The conveyor speed limit device is preferably designed as a mechanical and/or pneumatic second brake device. A brake device is understood, in particular, as a device that decelerates the articles and/or dissipates kinetic energy from the articles. For a first article inserted into the receive device, the conveyor speed limit device can subsequently lead, i.e., downstream from the first brake device, to the article being fully decelerated, i.e., to a standstill. A subsequently inserted article can then push the first inserted article further in the conveying direction with the speed specified by the first brake device. Depending on the section length between the first brake device and the acceleration device in relation to the article length, more or fewer articles may be needed to convey the first article up to the acceleration device. In this manner, the article is brought to a correspondingly specifiable speed in order to create a hole or gap between the first article and the following article. In the case of the conveying of an article with a defined speed by another article and corresponding detaining or braking by the second brake device, any pressure surges can then no longer ensure that the article decelerated by the second brake device receives in an undefined manner a speed that is too high.

The conveyor speed limit device or the second brake device preferably has a brush and/or at least a spring-steel plate and/or a braked roller. The second brake device preferably has elements pressing against an article, such as bristles of a brush or steel plates acting in a spring-like manner. A roller pair can also be provided or a brush pair or a spring-steel plate pair or several spring-steel plates, brushes and rollers. The rollers can preferably be braked rollers, which are not driven. Moreover, the braked roller or the braked roller pair is preferably a passive brake element.

The conveyor speed limit device is preferably designed as a suction air device acting transversely of the axis on the rod-like articles. In particular and preferably, a suction air device, which has an effect on the rod-like articles transversely to a rod axis, can be provided in addition to or in combination with a brush and/or a spring-steel plate and/or a braked roller. It is also possible that the suction air device is integrated in the brush and/or the spring-steel plate and/or in the braked roller.

The first brake device is preferably designed as a brake roller pair. The brake roller pair is preferably driven with a specifiable rotation speed.

The acceleration device is preferably designed as an acceleration roller pair.

An apparatus for conveying rod-like articles of the tobacco-processing industry to an article hopper with an aforementioned receive device according to the invention is especially preferred.

The invention is directed to a method for conveying rod-like articles, in particular filter rods, of the tobacco-processing industry. The articles are conveyed longitudinal-axially into a first brake device and are then decelerated in the first brake device to a first predetermined speed. The speed of the articles in a conveyor section following the brake device is restricted to a second predetermined speed. The conveyor section connected or adjacent, in particular directly, to the brake device follows the brake device. Furthermore, the conveyor section is arranged downstream in the conveyor direction of the first brake device. The conveyor section lies in particular between the first brake device and the acceleration device. Through the method according to the invention, the operational reliability of the conveyance of rod-like articles is increased considerably, since occurring pressure surges do not lead to the fact that a second predetermined speed is exceeded so that a defined conveyance is possible with a speed specifiable by the brake device.

The second predetermined speed preferably matches the first predetermined speed, i.e., the second predetermined speed is then mainly identical to the first predetermined speed. This can occur for example in that the articles located in the conveyor section, which are no longer in the working area of the first brake device and not yet in the working area of the acceleration device, are loaded through the longitudinal-axial pushing of another following article located in the first brake device. The first brake device is driven. Alternatively, the second predetermined speed can be smaller than the first predetermined speed.

The speed of the articles is preferably increased downstream from the conveyor section. Corresponding holes or gaps, which are for example desired in order to convey the articles transversely to the article axis after the acceleration, can hereby be created between the articles.

A second brake device, which permanently removes energy from the articles in the contact or active area of the second brake device, is preferably provided for restriction to the second predetermined speed. Thus, a type of braking takes place, when kinetic energy is constantly introduced into the article, whereby the second brake device does not bring the article to a standstill, but rather causes the article to receive no higher speed than the article pushing it.

An article arranged in tie active area of the second brake device is preferably pushed in the conveyor direction at least partially by an article arranged upstream.

Furthermore, the second brake device preferably provides mechanical friction with the articles in the active area of the second brake device.

A low pressure is preferably exerted transversely of the axis in the articles in the working area of the second brake device.

The invention is directed to a receive device of a conveyor unit for transporting rod-like articles for tobacco-processing. The receive device includes a deceleration device to decelerate the rod-like articles and an acceleration device to accelerate the rod-like articles. The acceleration device is arranged downstream from the deceleration device. A conveyor speed limit device is located between the deceleration device and the acceleration device.

According to a feature of the invention, the rod-like articles can include filter rods.

In accordance with another feature, the deceleration device may include a brake device.

The conveyor speed limit device can include at least one of a mechanical and a pneumatic brake device. Further, the at least one of a mechanical and a pneumatic brake device may include at least one of a braked roller and spring-like elements arranged to press against the rod-like articles. Also, the at least one of a mechanical and a pneumatic brake device may include at least one of a brush and at least a spring-steel plate.

According to still another feature of the instant invention, the conveyor speed limit device can include a suction air device acting transversely to an axis of the rod-like articles.

In accordance with a further feature, the deceleration device can include a brake roller pair.

Still further, the acceleration device can include an acceleration roller pair.

The invention is directed to an apparatus for conveying rod-like articles of the tobacco-processing industry to an article hopper with the above-described receive device.

The invention is directed to a method for conveying rod-like articles of tobacco-processing. The method includes longitudinally-axially conveying the articles into a first brake device to decelerate the articles to a first predetermined speed, and restricting a speed of the articles in a conveyor section following the first brake device to a second predetermined speed.

According to feature of the instant invention, the conveyor section can directly follow the first brake device.

In accordance with another feature of the invention, the second predetermined speed can be equal to or less than the first predetermined speed.

The method can also include increasing a speed of the articles downstream from the conveyor section.

In accordance with still yet another feature of the present invention, the restricting of the speed may include permanently removing energy from the articles in a contact area of a second brake. The method can also include pushing an article arranged in the contact area of the second brake in the conveyor direction. The pushing can be performed at least partially by an upstream arranged article. Moreover, the second brake device can apply mechanical friction to the articles. Also, vacuum pressure can be exerted transversely of an axis on the article in the contact area of the second brake device.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In the following figures, the same or similar types of elements or corresponding parts are provided with the same reference numbers in order to prevent the item from needing to be reintroduced.

Figure 1:
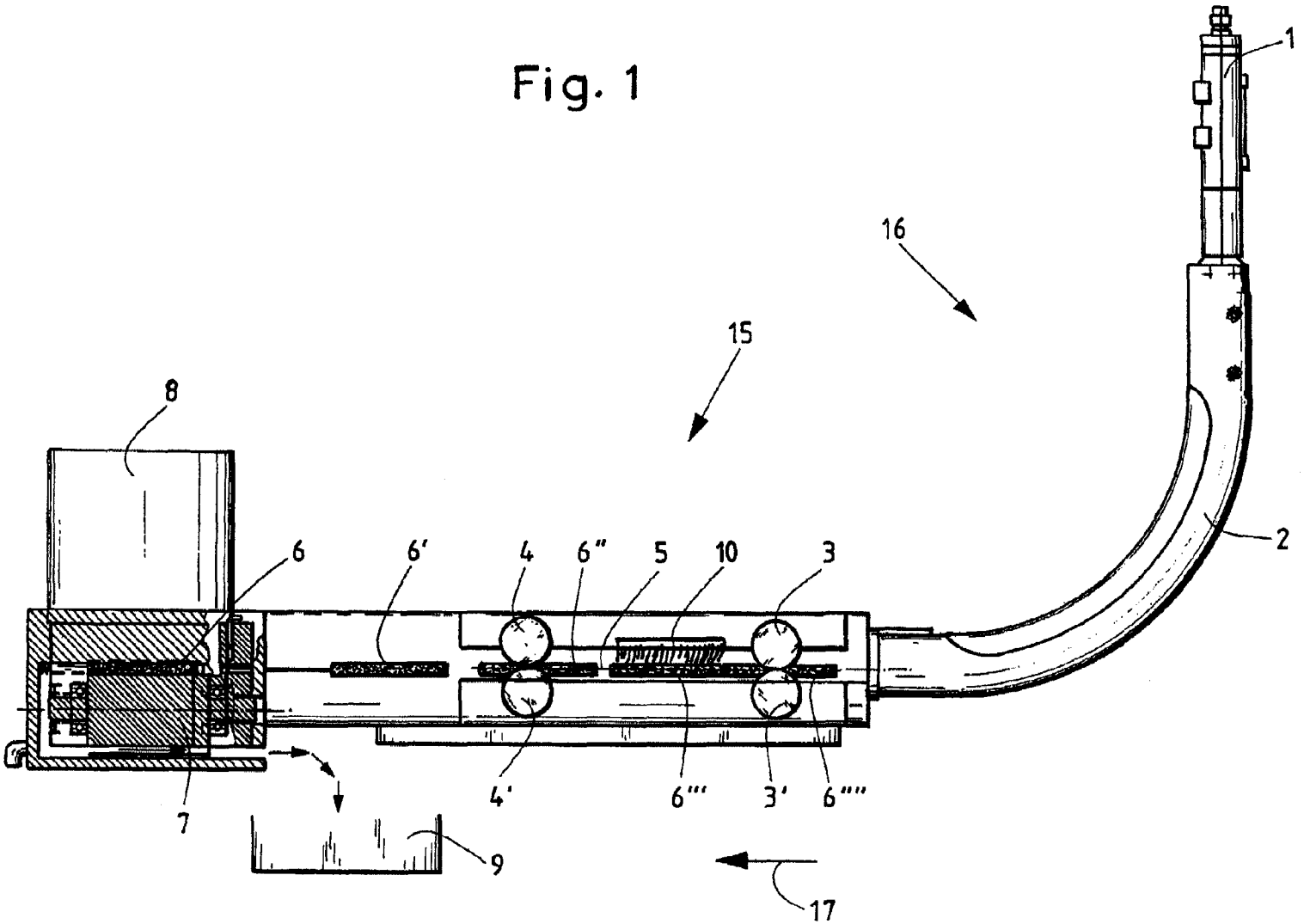
FIG. 1 schematically illustrates a side view of a first embodiment of a receive device according to the invention.

FIG. 1 schematically illustrates a receive device 15 according to the invention for conveying rod-like filter elements 6, 6', 6", 6''' or 6''''. After they have been cut for example into filter elements of a double usable length, filter elements 6-6'''' inserted into filter element hopper 8 can be brought together with a tobacco rod having a double usable length in order to create filter cigarettes. Filter elements 6-6'''' conveyed into filter element hopper 8 can also be cut into corresponding filter segments and conveyed into an arrangement of filter segments for production of multi-segment filters. The device according to the invention can be assigned to several or all functional units of an apparatus for the combination of groups of filter segments for production of multi-segment filters of the tobacco-processing industry according to DE 101 55 292.0, which is assigned to the assignee of the invention. Moreover, the disclosure of DE 101 55 292.0 is expressly incorporated by reference herein in its entirety.

Filter rods 6-6'''' are conveyed to a connection line 1 via a pipeline of a filter producing machine by a filter element feed station. The pipeline is not shown in FIG. 1. Filter elements 6-6'''', which are conveyed in a spaced manner in the supply pipe to connection line 1, then make their way into a curved guide 2, in order to be decelerated by brake rollers 3, 3' in a channel 5. Filter elements 6 are then conveyed into a drum 7 via a guide (not shown) by acceleration rollers 4, 4'. Drum 7 and the other elements are described in greater detail in EP 1 397 968 B1, the disclosure of which is expressly incorporated by reference herein in its entirety. FIG. 1 shows that a filter rod 6 fits in or on drum 7 in order to be conveyed into hopper 8 in a direction transverse to a rod axis. Examinations of filter rod 6 are also performed in order to determine, e.g., whether it is damaged. If filter rod 6 is damaged, it is delivered to or ejected into a collection container 9, as shown in FIG. 1.

Figure 2:
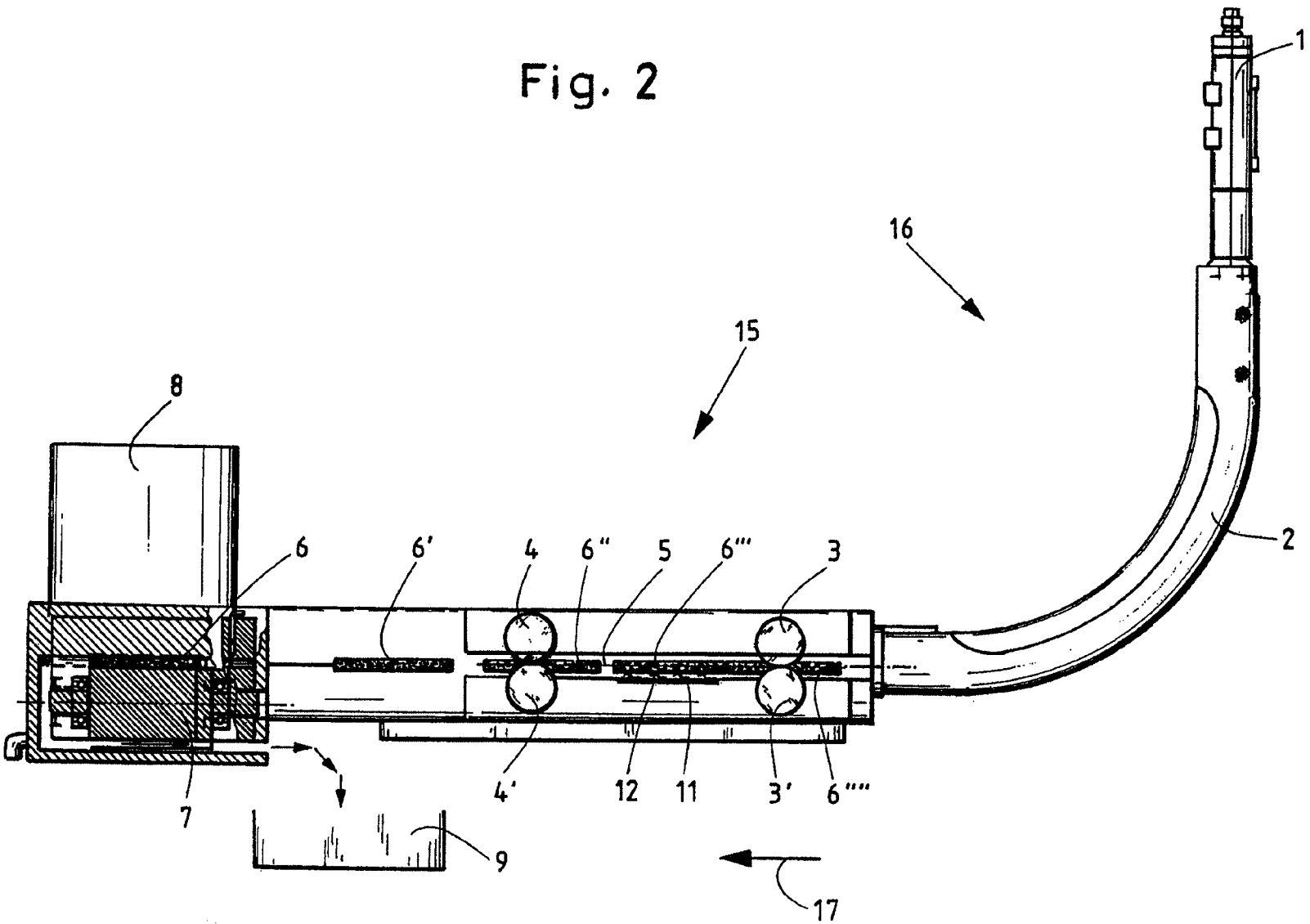
FIG. 2 schematically illustrates a side view of a second embodiment of a receive device according to the invention.

Receive device 15 can be part of a conveyor apparatus 16 or can be arranged after the conveyor apparatus 16, with reference to the conveyor direction. In accordance with the invention, receive device 15 equalizes the longitudinal transport speed of filter rods 6-6'''' conveyed into it in undefined states from the pipeline, which is arranged upstream from connection line 1, and produces a hole or gap required for the lateral removal. For this, filter rods 6-6'''' are brought by brake roller pair 3, 3' to a defined brake speed $V_{Brake}$. With this speed, the filter rods are moved on to accelerator rollers 4, 4', which are designed as accelerator roller pairs. In the case of accelerator roller pair 4, 4', filter rods 6-6'''' are brought to an acceleration speed $V_{Acceleration}$ and thus move away from the subsequent, slow filter rods 6''' and 6''''. In each exemplary embodiment of FIGS. 1-3, filter rods 6' and 6" move away with the corresponding speed, thereby creating a hole or gap, to load drum 7 to facilitate the transport of filter rods transversely to an axis of drum 7 into hopper 8.

Brake roller pair 3, 3' has a fixed, specifiable distance from accelerator roller pair 4, 4'. This distance defines a conveyor section, in which filter rods can, e.g., be conveyed without being in contact with an accelerator roller 4, 4' or a brake roller 3, 3'. The distance may be so great that the longest filter rod to be processed, e.g., with a length of 180 mm, cannot be grabbed simultaneously by the brake rollers 3, 3' and accelerator rollers 4, 4'.

During the processing of short filter rods, free flying filter rods, which are neither held by the brake rollers 3, 3' nor by the accelerator rollers 4, 4', result due to the distance between the brake rollers 3, 3' and the accelerator rollers 4, 4'. In this case, influences from the pipeline can cause impacts from the pipeline in the form of an impulse to be transferred to a free flying filter rod (e.g., 6'''), which in this case would increase its speed, resulting in creation of an insufficient hole or gap, which would be a malfunction in receive device 15.

Figure 3:
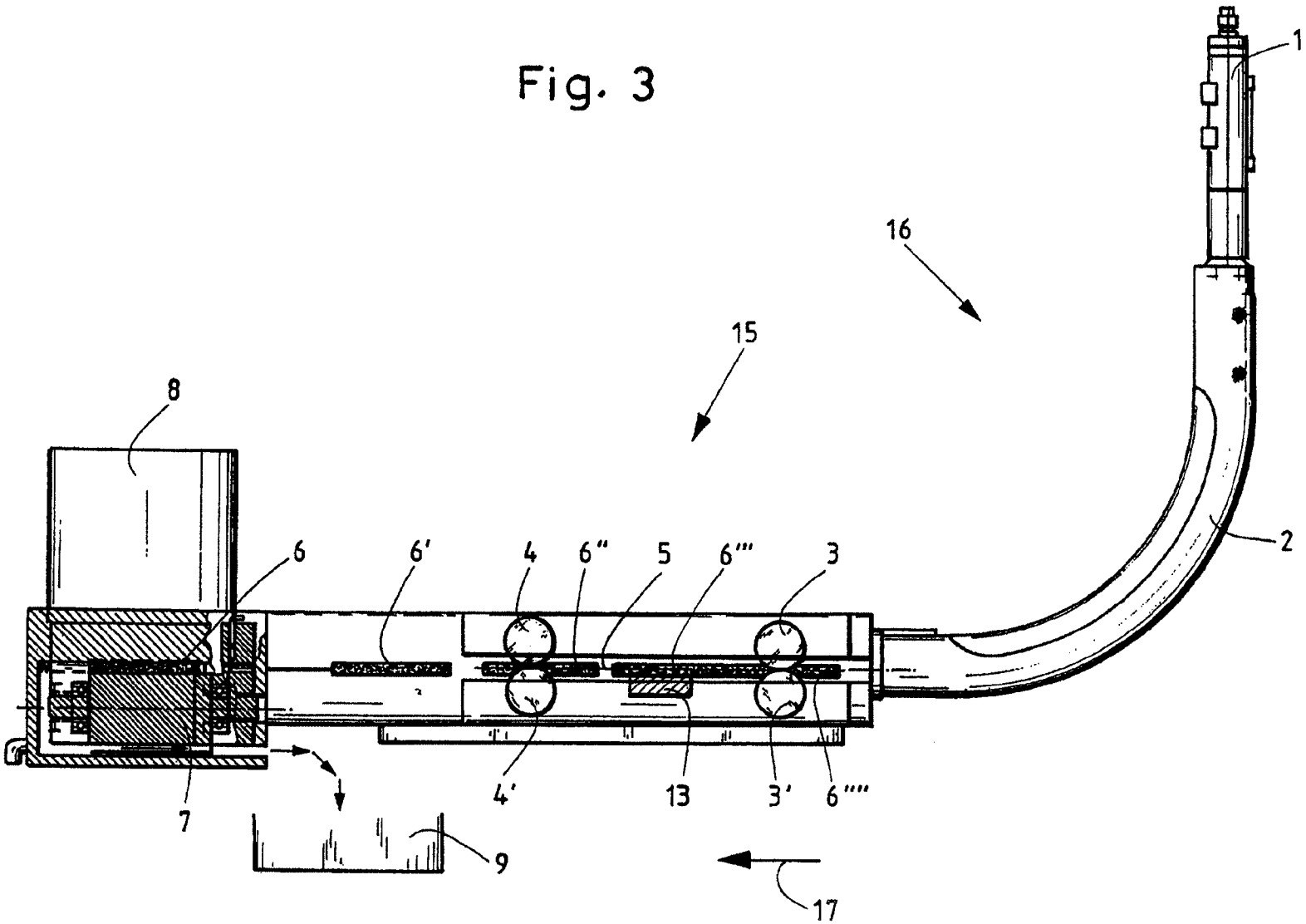
FIG. 3 schematically illustrates a side view of a third embodiment of a receive device according to the invention.

Through the incorporation of a conveyor speed limit device for example in the form of a brush 10 (see, e.g., FIG. 1), it can be ensured that such an impulse, which is transferred to free flying filter rod 6''' for example via filter rod 6'''' located in brake roller 3, 3', does not lead to an undesirably small hole or gap and thus to a malfunction. The bristles of brush 10 are thus as soft as possible in order to not damage the filter rods. Alternatively, according to FIG. 2, a spring-steel plate device 11, which has, e.g., four spring-steel plates 12 in this exemplary embodiment, may be provided. Many more spring-steel plates 12 can also be provided. Spring-steel plates 12 are also preferably relatively soft in order to not damage the filter rods. As the name implies, spring-steel plates 12 are designed to be correspondingly flexible and push transversely to an axis of and against filter rod 6'''. According to another variant, a suction device 13, which has suction air openings to filter rod 6''', can be provided, as illustrated in FIG. 3. Through the low pressure or vacuum pressure created, filter rod 6''' is suctioned toward suction device 13 and kinetic energy is correspondingly removed from filter rod 6'''.

Subsequent filter rod 6'''', which is conveyed so as to be arranged in brake roller pair 3, 3', pushes filter rod 6''' at brake roller pair speed $V_{Brake}$ conveyor direction 17. Conveyor speed limit devices 10 through 13 ensure that filter rod 6''' receives no undefined high speeds through pressure surges for example from the pipeline or connection line 1.

Instead of the arrangement of the conveyor speed limit devices 10 through 13 below the filter rods or in the bottom area of the channel 5 or above it or in the upper area of channel 5, other arrangements can also be possible, for example laterally. However, these are not shown in the figures. Opposite-lying brushes, spring-steel plates or suction devices can also be provided. A corresponding ring, which works around the perimeter of the filter rod, can also be provided, through which the filter rod must pass. A force can be correspondingly exerted on the filter rod from each side, in order to restrict its speed in a defined manner. Finally, a combination of different variants is also conceivable; for example, a combination of one brush with a spring-steel plate or brake plate can be provided. For example, relatively soft brush sections can be provided, to which one or more spring-steel plates connect in the conveyor direction. It is also possible to provide a combination of brushes or spring-steel plates with a suction device. Through the measures according to the invention, the operational reliability of receive device 15 is increased considerably. The receive device can be independent of malfunctions coming to the receive device from the pipeline.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCES

1 Connection line
2 Curved guide
3, 3' Brake roller
4, 4' Accelerator roller
5 Channel
6, 6', 6'', 6''', 6'''' Filter rod
7 Drum
8 Hopper
9 Collection container
10 Brush
11 Spring-steel plate device
12 Spring-steel plate
13 Suction device
15 Receive device
16 Conveyor apparatus
17 Conveyor direction

What is claimed:

1. A receive device of a conveyor unit for transporting rod-like articles for tobacco-processing, comprising:

a deceleration device to decelerate the rod-like articles;

an acceleration device to accelerate the rod-like articles, wherein the acceleration device is arranged downstream from the deceleration device; and a conveyor speed limit device located between the deceleration device and the acceleration device, the conveyor speed limit device comprising at least one of:

a mechanical brake device having at least one of a brush and at least a spring-steel plate; and a pneumatic brake device having a suction air device acting transversely to an axis of the rod-like articles.

2. The receive device in accordance with claim 1, wherein the rod-like articles comprise filter rods.

3. The receive device in accordance with claim 1, wherein the deceleration device comprises a brake device.

4. The receive device in accordance with claim 1, wherein the mechanical brake device comprises at least one of a braked roller and spring-like elements arranged to press against the rod-like articles.

5. The receive device in accordance with claim 1, wherein the deceleration device comprises a brake roller pair.

6. The receive device in accordance with claim 1, wherein the acceleration device comprises an acceleration roller pair.

7. An apparatus for conveying rod-like articles of the tobacco-processing industry to an article hopper with a receive device in accordance with claim 1.

8. A method for conveying rod-like articles of tobacco-processing, comprising:

longitudinally-axially conveying the articles into a first brake device to decelerate the articles to a first predetermined speed; and restricting a speed of the articles in a conveyor section following the first brake device to a second predetermined speed, wherein the restricting of the speed comprises permanently removing energy from the articles in a contact area of a second brake that comprises at least one of:

a mechanical brake device having at least one of a brush and at least a spring-steel plate; and a pneumatic brake device having a suction air device so that vacuum pressure is exerted transversely of an axis on the article in the contact area of the second brake device.

9. The method in accordance with claim 8, wherein the rod-like articles comprise filter rods.

10. The method in accordance with claim 8, wherein the conveyor section directly follows the first brake device.

11. The method in accordance with claim 8, wherein the second predetermined speed is equal to or less than the first predetermined speed.

12. The method in accordance with claim 8, further comprising increasing a speed of the articles downstream from the conveyor section.

13. The method in accordance with claim 8, further comprising pushing an article arranged in the contact area of the second brake in the conveyor direction.

14. The method in accordance with claim 13, wherein the pushing is performed at least partially by an upstream arranged article.

* * * * *